US005908425A

United States Patent [19]

Adam

[11] Patent Number: 5,908,425

[45] Date of Patent: Jun. 1, 1999

[54] DEPILATORY DEVICE AND METHOD OF USE

[76] Inventor: Helen Adam, 2420 Meadow Rue, Modesto, Calif. 95355

[21] Appl. No.: 08/935,354

[22] Filed: Sep. 22, 1997

[51] Int. Cl.[6] ..... A61B 17/50

[52] U.S. Cl. ..... 606/133; 606/43

[58] Field of Search ..... 606/133, 131, 606/43, 1

[56] References Cited

U.S. PATENT DOCUMENTS

| | | | |
|---|---|---|---|
| 1,588,387 | 6/1926 | Li et al. | 606/133 |
| 4,983,175 | 1/1991 | Daar et al. | 606/133 |
| 5,643,287 | 7/1997 | Ahad | 606/133 |

*Primary Examiner*—Michael Buiz
*Assistant Examiner*—Vy Quang Bui
*Attorney, Agent, or Firm*—Carol D. Titus; James J. Leary; Patrick T. Reilly

[57] ABSTRACT

A method and apparatus for hair removal are provided. A hand held, manually operated depilatory device removes hairs located along a length of a linear axis. A string-like, elongate element is positioned within a frame and may be removed for cleaning or replacement. Hair is engaged with and captured by a moving twisted engagement of an elongate, string-like element and pulled away and removed from the skin of a subject. The elongate element is removable and replaceable which improves hygienic maintenance and performance adjustment of the apparatus. The length of the twisted engagement and the number of its twists are adjustable by a user.

21 Claims, 2 Drawing Sheets

DEPILATORY DEVICE AND METHOD OF USE

FIELD OF THE INVENTION

The present invention relates generally to depilatory devices and techniques for hair removal. More particularly, it relates to manually operated mechanical depilatory devices and methods for their use in selective removal of hair.

BACKGROUND OF THE INVENTION

Devices and methods for selective hair removal have long existed in the fields of cosmetology and medicine. Wax based preparations are widely used to remove body and facial hair. Cold wax techniques have limited effectiveness, and hot wax preparations are typically painful to apply and can be damaging to the skin. Chemical depilatories are cumbersome to use and can also be insulting and damaging to human skin tissue.

U.S. Pat. No. 4,983,175, granted to Daar et al., discloses an electrically powered depilatory device which employs elongate elements, i.e. threads or strings, in a mutually twisted engagement . A motor within the housing of the device drives the elongate elements in motion around and beyond the linear action of the twisted engagement to cause a continuous twisting action. This twisting action engages the strands of a subject's hair between the elongate elements. The hair is then intertwined within the mutually twisted engagement of the elongate elements. The position of the twisted engagement remains static in relationship to the housing of the depilatory device, which causes the hair to be wound around the twisted engagement and for the hair to be laterally displaced from its root by a double action hair removal.

The static positional relationship of the twisted engagement to the housing, in the invention of Daar et al., limits the depilatory device to removing hair from only a small portion of a subject's skin at a time. The hair removal process of the application of a device designed according to Daar et al. therefore delivers a low level of efficiency to a user. In addition, the inclusion of an electric motor in the device of Daar et al. limits its safe and effective use in either moist environments or in combination with lotions and emollients. Furthermore, the need for electric power requires a user to have either portable batteries or an available source of compatible electric power.

SUMMARY OF THE PRESENT INVENTION

It is an object of the present invention to provide a depilatory device for removal of hair from the face and body of a subject. It is also an object of the invention to provide an embodiment which is a manually operated mechanical depilatory device that does not require electricity and can, therefore, be safely used in moist environments and in combination with lotions and liquid emollients. It is yet another object of the invention to provide a depilatory device where the hair engaging portion of the device translates across the surface of the subject's skin to enhance the hair removal action and to remove hair from a wider area of skin.

There is thus provided by the present invention and in accordance with the above stated objects a hand held, manually operable depilatory device and a method or operation thereof. The present invention includes an elongate element held within and arranged by a frame assembly. The elongate element is strung within the frame assembly and includes a twisted engagement. The frame assembly includes integrated articulating parts, to some of which the elongate element is strung. An operator causes the twisted engagement of the elongate element to move in relationship to the frame assembly by manually manipulating predesignated parts of the frame assembly. This movement of certain articulating parts of the frame assembly redefines the exact momentary shape of the elongate element and therefore the instantaneous position of the twisted engagement relative to the frame assembly.

The material of the elongate element is strong and flexible. The movement pathway of the twisted engagement allows an operator to capture and remove hairs from the subject's skin as the twisted engagement traverses across an area of skin. The structure of the twisted engagement is dynamic as the twisted engagement is repositioned by portions of the elongate element material. As parts of the frame are manipulated to cause the twisted engagement to move from position to position, individual points and lengths of the elongate element itself form the structure of the twisted engagement and are then, as the twisted engagement continues to move further on, pass outside of the structure of the twisted engagement.

There is thus provided, in accordance with a preferred embodiment of the present invention, a string assembly which includes an elongate element having a tensioner, and a frame assembly. The frame assembly includes a base fork, two articulating handle members and two articulating guide arms. The elongate element is strung along several locating posts which are found on the handle members and/or guide arms. The tensioner maintains the elongate element in a state of tension and attaches the elongate element to an anchor point located on the base fork.

The handle members each present a length, a finger grip end and a blunt end. The base fork design includes a body, two tines, a slot and a tensioner anchor point. Each of the lengths of the handle members are separately and rotationally attached to different tines of the base fork. The handle members are thus manipulated by a user applying physical pressure to the finger grip ends. The resulting movement of the handle members redefines the shape of the elongate element and drives the twisted engagement along a pathway.

The guide arms are used to regulate and synchronize the motion of the handle members. The guide arms each include a base fork end and a handle member end. Both base fork ends are rotationally connected together by a pivot post. The pivot post passes through the slot of the base fork and the base fork ends of both guide posts. The pivot post constrains the range of motion of the guide post base fork ends to along an axis defined by the base fork slot. Each of the handle member ends are separately rotationally attached to alternate handle member lengths. The mechanical linkage thus created by the rotational attachments of the guide arms to the pivot post and the two handle members imposes a coordination of the movement of the two handle members in relationship to each other and the base fork. This coordinated movement results in a more predictable and stable movement of the twisted engagement and user-friendly operation of the present invention.

In certain preferred embodiments of the present invention an additional tensioning element is strung between the blunt ends of each of the handle members. This tensioning element compresses the two blunt ends together and along a radius established by the relative positions of the rotational attachment points of the handle members to separate tines of the base fork. This force as introduced by the tensioning element tends therefore to pull the finger grip ends of the two handle members away from each other. Preferred embodiments of this type automatically tend to pull the blunt ends of the two hand members together while causing the correspondent finger grip ends to separate away from each other. This tension created by the attachment of the tensioning element is useful in certain preferred embodiments of the present invention by providing a more comfortable method of operation to the user of the invention. The anatomy of the human hand makes it easier for a user of the present invention to single handedly compress the two finger grip ends together than to pull them away from each other. An operator of the present invention will typically place the thumb and the forefinger of the same hand into separate finger grips of the invention. The muscles and bones of the hand are arranged so that the compression of the finger grips together by the forefinger and the thumb of the same hand is easier and less straining to accomplish than the action of pushing the finger grips away from each other with the hand in this typical operating position. The direction of the force provided by the addition of the tensioning element to the design of certain preferred embodiments of the present invention allows for more comfortable operation by driving the finger grips away from each other when the operator relaxes his or her operating hand. This embodiment requires the operator to deliver manual force in operating the present invention only in the directions of muscular motion which are more comfortable, and allows the force contributed by the tensioning element to, when the operator simply ceases to apply a compressive force, independently return the handle members to a position of device equilibrium wherein the finger grips are relatively separated from each other.

A preferred method of operation of certain preferred embodiments the present invention includes the steps of a user (1) placing his or her thumb and forefinger of the same hand into separate finger grips, (2) aligning the frame of the invention about an area of a subject's skin, (3) aligning the twisted engagement where its direction of motion will cause it to engage and capture a hair or hairs which are to be removed from the subject, (4) manually compressing the two finger grips together, which causes the twisted engagement to move along a line of motion while removing hair, (5) relaxing his or her grip and allowing the force from the tensioning element to force the finger grips away from each other, and removing additional hair along a line of motion of the twisted engagement in a direction opposite to the motion caused in step 4.

The method of operation of certain preferred embodiments of the present invention which do not include a tensioning element may require that the operator manually push the finger grips away from each other as an alternative to step 5 of the method of operation described above.

It will be appreciated that the operator and the subject are the same person in certain alternate methods of operation of the present invention.

Certain alternate preferred embodiments of the present invention can be motorized. These versions of the invention are most useful in applications outside of moist environments and in the absence of ointments or emollients, but where the convenience of electrical control and actuation is desirable.

BRIEF DESCRIPTION OF DRAWINGS

The present invention will be understood and appreciated more fully from the following detailed description, taken in conjunction with the following drawings in which.

DETAILED DESCRIPTION OF A PREFERRED EMBODIMENT

The following disclosure is descriptive only and not intended to limit the scope of the invention. Various alternate preferred embodiments of present invention are made evident to one skilled in the art and in light of the following disclosure.

Figure 1:
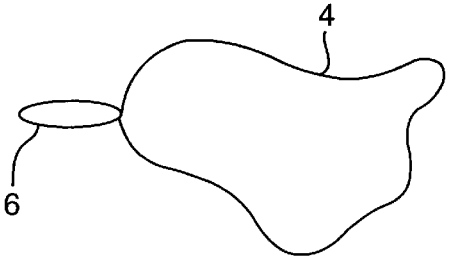
FIG. 1 illustrates a string assembly as included in certain preferred embodiments of the present invention.

Reference is first made to FIG. 1, which illustrates a string assembly 2 composed of an elongate element 4 and a tensioner 6. Preferable material for elongate element 4 is a natural or synthetic fiber, such as cotton, silk or plastic. Alternate materials include natural rubber, synthetic rubber, and other synthetics or natural fibers and/or combinations of these and other flexible materials. Preferably the fiber of elongate element 4 has a gripping surface and/or a surface coating of a gripping material such as wax or an adhesive. Tensioner 6 is preferably composed of a strong elastic material such as rubber, synthetic rubber or an elastic plastic or other strong elastic materials. Tensioner 6 insures that elongate element 4 is kept in a state of tension when they are both properly installed as operating components of the present invention.

FIGS. 2, 3, 4 and 6 are bottom, top and side views of the same preferred embodiment of the present invention.

Figure 2:
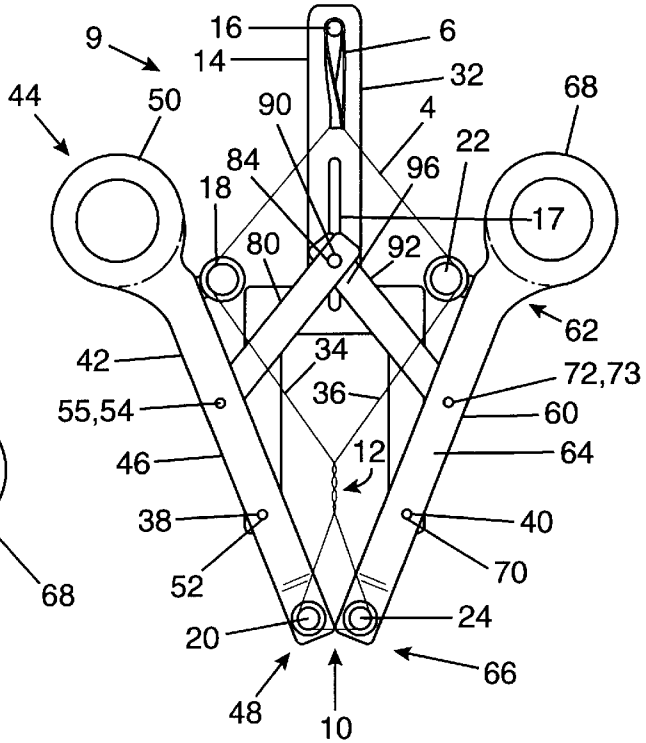
FIG. 2 is a bottom view of a preferred embodiment of the present invention.

Referring first to FIG. 2, a bottom view of a preferred embodiment of the present invention, or device 10, is presented. The side of the device displayed in FIG. 2 is the side that is typically placed closest to the skin of a subject in the application of the device 10.

Figure 3:
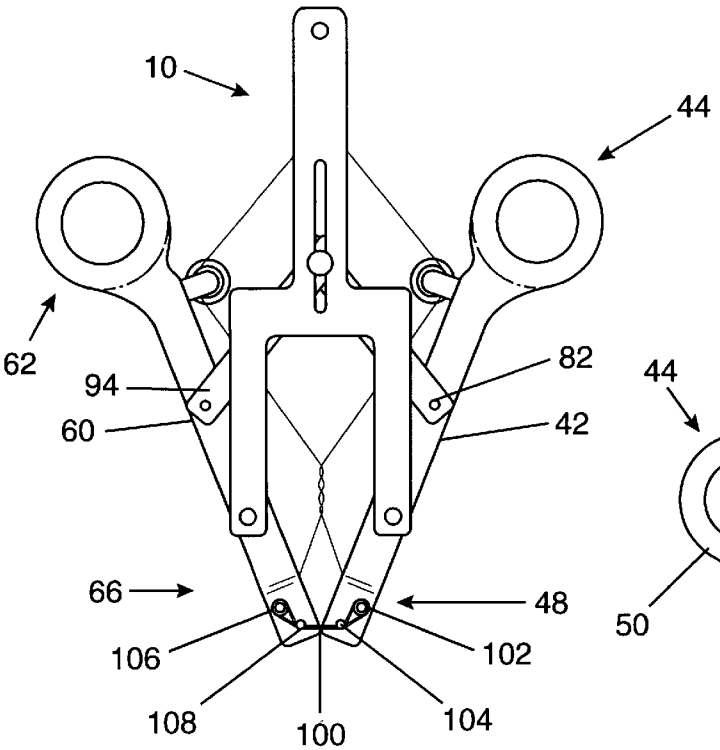
FIG. 3 is a top view of a preferred embodiment of the present invention.

The hair removal device 10 is composed of frame 9 and string assembly 2 and a tensioning element 100. Please note that tensioning element 100 is depicted in FIG. 3, and is further discussed below. String assembly 2 is shown to be properly installed within frame 9, in an intended arrangement that is described after the discussion of frame 9.

Frame 9 includes first handle member 42, second handle member 60, base fork 14, first guide arm 80, second guide arm 92 and pivot post 90. These components of frame 9 are of all of rigid construction and are composed of metal, metal alloy, plastic or other relatively rigid materials.

First handle member 42 and second handle member 60 are mirror images of each other. Both handle members 42 and 60 are mechanically linked to base fork 14 by direct rotational attachment and through separate rotational attachment to one of the guide arms 80 and 92. In normal operation of device 10, an operator places his or her thumb, not shown, into finger grip 50 of first handle member 42 and the forefinger of the same hand, also not shown, into finger grip 68 of second handle member 60. The operator then positions the device 3 against a skin area of his or her own, or of another subject, and compresses the finger grips 50 and 68 towards each other.

First handle member 42 includes finger grip end 44, segment 46 and blunt end 48. Finger grip end 44 includes finger grip 50 and locating post 18. Locating post 18 is used to hold and position elongate element 4 within frame 9.

Rotational attachment point 52 and rotational attachment point 54 are features of segment 46. First handle member 42 is directly and rotationally attached to tine 34 of base fork 14 at rotational attachment point 52 by means of rotational post 38. Furthermore, first handle member 42 is mechanical linked to base fork 14 by means of rotational attachment of segment 46 at rotational attachment point 54 to guide arm 80. Blunt end 48 includes locating post 20, and further presents an anchor point 102 and a buffer post 104 as disclosed below in FIG. 3. Locating post 20 is used to hold elongate element 4 within frame 9.

Second handle member 60 includes finger grip end 62, segment 64 and blunt end 66. Finger grip end 62 includes finger grip 68 and locating post 22. Locating post 22 is used to hold and position elongate element 4 within frame 9.

Rotational attachment point 70 and rotational attachment point 72 are features of segment 64. Second handle member 60 is directly and rotationally attached to tine 36 of base fork 14 at rotational attachment point 70 by means of rotational post 40. Second handle member 60 is also mechanically linked to base fork 14 by means of rotational attachment of segment 64 at rotational attachment point 72 to second guide arm 92. Blunt end 66 includes locating post 24, and further presents an anchor point 106 and a buffer post 108 as disclosed below in FIG. 3. Locating post 24 is used to hold and position elongate element 4 within frame 9.

Base fork 14 provides a stable base for the articulation of handle members 42 and 60, and guide arms 80 and 92. Base fork 14 includes body 32, tine 34 and tine 36. Body 32 includes slot 17 and anchor point 16. Rotational post 38 is affixed to tine 34, and rotational post 40 is affixed to tine 36. In normal operation of device 10 first handle member 42 rotates about rotational post 38 and second handle member 60 rotates about rotational post 40.

Guide arm 80 includes rotational post 55, base fork end 84 and first member end 82. Guide arm 92 includes rotational post 73, second member end 94 and base fork end 96. Guide arm 80 mechanically links first handle member 42 to the slot 17 of base fork 14. Guide arm 80 is rotationally attached by means of rotational post 55 at attachment point 54. Guide arm 80 is also mechanically linked to guide arm 92 and slot 17 by pivot post 90. Pivot post 90 passes through both guide arms 80 and 92 and slot 17. Guide arms 80 and 92 are rotationally attached to pivot post 90. Pivot post 90 remains limited to a range of motion defined by slot 17. Guide arms 80 and 92 are therefore also limited in their respective ranges of motion by the limited mobility of pivot post 90.

Elongate element 4 is strung along locating posts 18, 20, 22 and 24. Tensioner 6 is attached to elongate element 12 and anchor point 16. Tensioner 6 pulls elongate element 4 towards anchor point 16 at all times, and thereby keeps elongate element 4 continuously under tension. The instantaneous shape of elongate element 4 is therefore defined by the relative momentary positions of locating posts 18, 20, 22 and 24 and anchor point 16. These positions are varied by altering the positions of handle members 42 and 60 relative to each other and to base fork 14. Guide arms 80 and 92 govern the movement of handle members 42 and 60 so that twisted engagement 12 is driven through a symmetrical and predictable range of motion during the normal operation of device 10.

As an operator compresses finger grips 50 and 68, handle members 42 and 60 rotate respectively about attachment points 52 and 70. The motion of guide arms 80 and 92 are constrained by pivot post 90. This constraint imposes a regularity to the relative motions of handle members 42 and 60. It is preferred, for predictable and symmetric movement of handle members 42 and 60, that the length between pivot post 90 and attachment point 54 and the length between pivot post 90 and attachment point 72 be equal. It is also preferred, for predictable and symmetric movement of handle members 42 and 60, that the length between attachment point 54 and rotational post 38 be equal to the length between attachment point 72 and rotational post 40. It is further preferred, again for the predictable and symmetric movement of handle members 42 and 60, that the length between rotational post 38 and locating post 20 be equal to the length between rotational post 40 and locating post 24.

The symmetrical and predictable movement of the handle members 42 and 60 imposed by the mechanical linking of the handle members 42 and 60 to slot 17 by means of guide arms 80 and 92 results in a more stable, predictable and user friendly motion of twisted engagement 12 during the operation of device 10.

Referring now to FIG. 3, where the top view of device 10 is disclosed, blunt end 48 of first handle member 42 is shown to further present an anchor point 102 and a buffer post 104, and blunt end 66 of second handle member 60 is shown to further present an anchor point 106 and a buffer post 108. Tensioning element 100 is attached to anchor point 102 of first handle member blunt end 48 and to anchor point 106 of second handle member blunt end 66. Tensioning element 100 is made of a strong elastic material such as rubber, synthetic rubber or an elastic plastic or other strong elastic materials.

When device 10 is not being used by an operator the force applied by tensioning element 100 draws blunt ends 48 and 66 towards each other and thereby defines a resting state for device 10. Device 10 is shown to be in this resting state in FIGS. 2 and 3.

Figure 4:
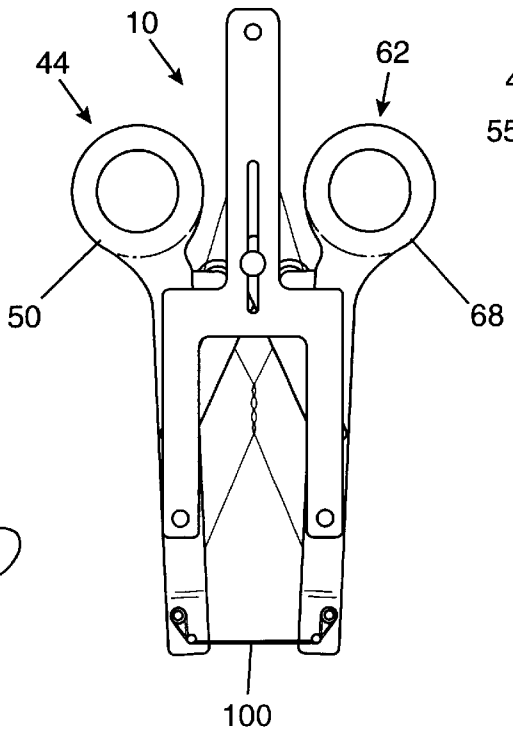
FIG. 4 is a bottom view of a preferred embodiment of the present invention, wherein the handle members are pulled together and the tensioning element is lengthened under increased tension.

Referring now to FIG. 4, a top view of device 10 where finger grips 50 and 68 are being compressed towards each other is depicted. Tensioning element 100 is elongated and stretched by the force compressing finger grips 50 and 68 and translated to tensioning element 100 via handle members 42 and 60.

In operation, a user or operator of device 10 places the thumb and forefinger of the same hand separately into finger grips 50 and 68. The user then positions frame 9 close to a section of a subject's skin. The user then squeezes finger grips 50 and 68 towards each other. The resulting movement of the handle members 42 and 60 forces tensioning element 100 to stretch in length as blunt ends 48 and 66 are pulled away from each other. Simultaneously, base fork ends 96, 84 and 96 of guide arms 80 and 92 are pushed along slot 17 and towards anchor point 16. The constraining linkage of guide arms 80 and 92 to handle members 42 and 60 causes the positions of handle members 42 and 60 to be consistently symmetric about an axis passing parallel to the length of slot 17, i.e. an axis extending from anchor point 17 and passing through pivot post 90, throughout the range of motion of handle members 42 and 60.

As finger grips 50 and 68 of handle members 42 and 60 are squeezed towards each other, the relative positions of locating posts 18, 20, 22 and 24 are altered. This alteration changes the momentary shape of elongate element 4 and forces twisted engagement 12 to move in the direction of anchor point 16. This displacement of twisted engagement 12 can be seen by comparing the location of twisted engagement 12 in FIGS. 2 and 3 with its location in FIG. 4.

The maintenance of a predictable movement pathway of twisted engagement 12 consistently along an axis that is approximately parallel to the length of slot 17 is aided by the mechanical linkage of handle members 42 and 60 to slot 17 by means of guide arms 80 and 92.

The movement of twisted engagement 12 from its location of FIGS. 2 and 3 to its position of FIG. 4 allows hairs from a subject to become entwined in twisted engagement 12 and pulled away from the subject's skin. The operator then relaxes his or her grip on finger grips 50 and 68 and allows the force of tensioning element 100 to pull blunt ends 48 and 66 towards each other. The motion imposed upon handle members 42 and 60 pulls guide arms 80 and 92 along slot 17 and away from anchor point 16. Locating posts 18, 20, 22 and 24 are again displaced which forces changes in the momentary shape of elongate element 4 as handle members 42 and 60 proceed through their ranges of motion. These changes in shape of elongate element 4 drives twisted engagement 12 in the direction of tensioning element 100. This returning movement of twisted engagement 12 again allows twisted engagement 12 to capture hairs of the subject and remove these hairs from the subject's skin.

The operator then repositions device 10 about a section of the subject's skin for another application of device 10.

The design of device 10 allows for the removal of string assembly 2 from frame 9. This quality of device 10 permits a user to either conveniently remove string assembly 2 for cleaning or to discard it and replace it with a new, clean string assembly 2. The user may also remove and replace a certain embodiment of string assembly 2 with a different embodiment in order to improve the performance of device 10 by matching a particular subject's hair with a more appropriate embodiment of string assembly 2. The number of twists in the twisted engagement and the length of the twisted engagement is also selectable and modifiable by the user. Twist counts of from four to eight and lengths of twisted engagement 12 from one eighth of an inch to three eighths of an inch are preferred. However, other numbers of twists and/or lengths of twisted engagement 12 may be used in other embodiments.

Figure 5:
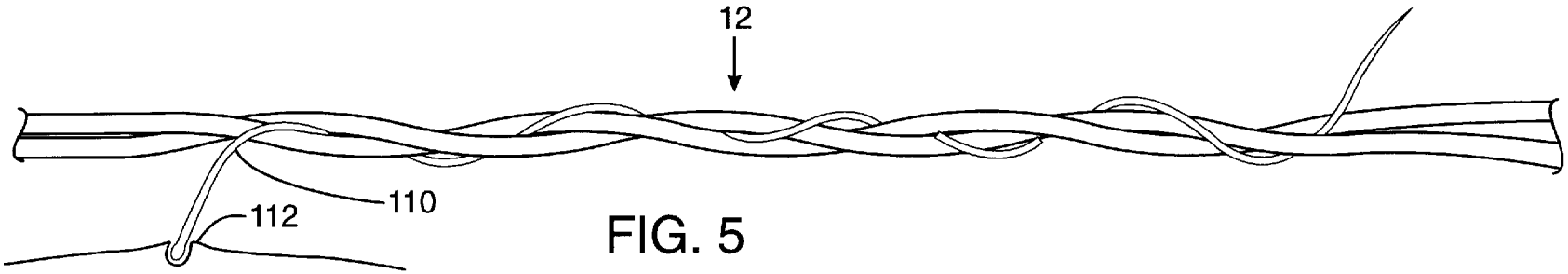
FIG. 5 depicts a hair rooted in skin and entwined in a twisted engagement.

Referring now to FIG. 5, hair 110 is shown to be rooted in skin site 112 and entwined in twisted engagement 12. As twisted engagement 12 moves away from skin site 112, hair 110 is pulled with twisted engagement 12 and away from skin site 112. This depilatory action removes hair 110 from skin site 112.

Figure 6:
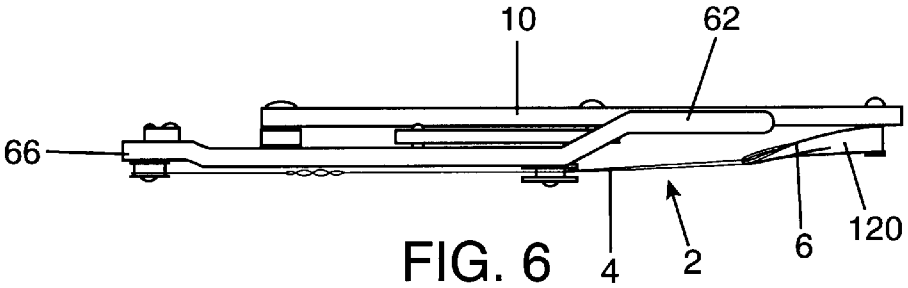
FIG. 6 is a side view of the preferred embodiment of the present invention of FIGS. 2, 3 and 4 in which the string assembly tensioner includes a tensioner made of an elastic tensioning material.

FIG. 6 presents a side view of the hair removal device 10, as shown in FIGS. 2, 3 and 4, and depicts a string assembly 2 in which tensioner 6 includes elastic band 120. Elastic band 120 is placed about anchor point 16, and maintains elongate element 4 under tension by pulling elongate element 4 towards anchor point 16.

Figure 7:
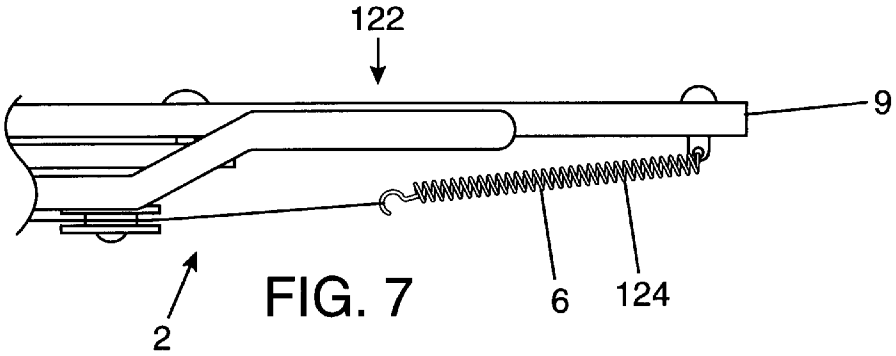
FIG. 7 is a side view of an alternate preferred embodiment of the present invention in which the tensioner is permanently attached to the device, and the string assembly is of a simpler design.

FIG. 7 shows a side view of an alternate preferred embodiment of the present invention 122 and depicts tensioner 6 as being permanently attached to the frame 9 as including spring 124. In the embodiment of FIG. 7 the elongate element 4 is removable from and replaceable into frame 9 and spring 124. Preferred embodiments of this type allow for a simpler design of elongate element 4 and string assembly 2.

I claim:

1. A hair removal device for removing hair from an area of skin, comprising:

a base member, having an anchor point, an elongate member attached to said base member, said elongate member having a twisted portion, an elastic tensioner attaching said elongate member to said anchor point of said base member, and impelling means for moving said twisted portion from a first location to a second location, said impelling means comprising;

a first locating post configured to support said elongate member, a second locating post configured to support said elongate member, a third locating post configured to support said elongate member, and a fourth locating post configured to support said elongate member, said first and third locating posts being movable with respect to one another, and said second and fourth locating posts being movable with respect to one another.

2. The hair removal device of claim 1 wherein said elongate member comprises a loop of material.

3. The hair removal device of claim 1 further comprising a second elongate member, said elongate members being in mutually twisted engagement to form said twisted portion.

4. The hair removal device of claim 1 wherein said impelling means further comprises first finger-engagement means and second finger-engagement means, each being pivotally attached to said base member and having a first position and a second position, and wherein moving said finger-engagement means between said first position and said second position moves said twisted portion between said first location and said second location.

5. A hair removal device for removing hair from an area of skin, comprising:

a base member, an elongate member attached to said base member, said elongate member having a twisted portion, and impelling means for moving said twisted portion from a first location to a second location, said impelling means comprising:

first finger-engagement means and second finger-engagement means, each being pivotally attached to said base member and having a first position and a second position, and wherein moving said finger-engagement means between said first position and said second position moves said twisted portion between said first location and said second location, a slot in said base member, a first guide arm having a first end and a second end, said first end being pivotally and slidably engaged with said slot, said second end being pivotally attached to said first finger-engagement means, and a second guide arm having a first end and a second end, said first end being pivotally and slidably engaged with said slot, said second end being pivotally attached to said second finger-engagement means.

6. The hair removal device of claim 5 further comprising a pivot post slidably engaging said slot, said first and second guide arms pivotally attached to said pivot post, thereby being pivotally and slidable engaged with said slot.

7. The hair removal device of claim 5 wherein said impelling means further comprises a plurality of locating posts, said elongate member being wrapped around said plurality of locating posts.

8. The hair removal device of claim 5 further comprising an elastic tensioner attached to said elongate member and to said base member.

9. The hair removal device of claim 1 wherein said elongate member is inelastic and formed of a waxed, filament material.

10. The hair removal device of claim 1 further comprising biasing means for biasing said twisted portion to be at said first location.

11. The hair removal device of claim 10 wherein said biasing means is formed of an elastic material.

12. A hair removal device for removing hair from an area of skin, comprising:

a base member, a first handle member having first finger-engagement means at a first end and a first locating post on a second end, said first handle member being pivotally attached to said base member, a second locating post located proximate said first finger-engagement means, a second handle member having second finger-engagement means at a first end and a third locating post on a second end, said second handle member being pivotally attached to said base member, a fourth locating post located proximate said second finger-engagement means, an elongate member disposed around said first, second, third, and fourth locating posts, said elongate member being in twisted engagement at a location between said first and third locating posts and said second and fourth locating posts, a fifth locating post which extends from a leg of said base member, and an elastic member attached to said elongate member and said fifth locating post, said hair removal device having a first position and a second position, wherein in said first position said second end of said first handle member is located proximate said second end of said second handle member, and the twisted section of said elongate member is at first location, and wherein in said second position said first finger-engagement means and said second finger-engagement are closer together than in said first position, said second ends of said first and second handle members are farther apart than in said first position, and the twisted section of said elongate member is at a second location, said second location being farther from said second ends of said first and second handle members than said first location.

13. A hair removal device for removing hair from an area of skin, comprising:

a base member having a first leg, a second leg, a third leg, and a slot located at least partially within said third leg, a first handle member having first finger-engagement means at a first end and a first locating post on a second end, said first handle member being pivotally attached to said base member, a second locating post located proximate said first finger-engagement means, a second handle member having second finger-engagement means at a first end and a third locating post on a second end, said second handle member being pivotally attached to said base member, a fourth locating post located proximate said second finger-engagement means, an elongate member disposed around said first, second, third, and fourth locating posts, said elongate member being in twisted engagement at a location between said first and third locating posts and said second and fourth locating posts, said hair removal device having a first position and a second position, wherein in said first position said second end of said first handle member is located proximate said second end of said second handle member, and the twisted section of said elongate member is at first location, and wherein in said second position said first finger-engagement means and said second finger-engagement are closer together than in said first position, said second ends of said first and second handle members are farther apart than in said first position, and the twisted section of said elongate member is at a second location, said second location being farther from said second ends of said first and second handle members than said first location.

14. The hair removal device of claim 13 further comprising:

a first guide arm having a first end slidably attached to said slot and a second end pivotally attached to said first handle member, a second guide arm having a first end slidably attached to said slot and a second end pivotally attached to said second handle member, and a fifth locating post depending from said third leg of said base member.

15. A hair removal device for removing hair from an area of skin, comprising:

a base member, a first handle member having first finger-engagement means at a first end and a first locating post on a second end, said first handle member being pivotally attached to said base member, a second locating post located proximate said first finger-engagement means, a second handle member having second finger-engagement means at a first end and a third locating post on a second end, said second handle member being pivotally attached to said base member, a fourth locating post located proximate said second finger-engagement means, an elongate member disposed around said first, second, third, and fourth locating posts, said elongate member being in twisted engagement at a location between said first and third locating posts and said second and fourth locating posts, said elongate member being replaceable, said hair removal device having a first position and a second position, wherein in said first position said second end of said first handle member is located proximate said second end of said second handle member, and the twisted section of said elongate member is at first location, and wherein in said second position said first finger-engagement means and said second finger-engagement are closer together than in said first position, said second ends of said first and second handle members are farther apart than in said first position, and the twisted section of said elongate member is at a second location, said second location being farther from said second ends of said first and second handle members than said first location.

16. The hair removal device of claim 12 further comprising a biasing means for biasing said hair removal device toward said first position.

17. A hair removal device for removing hair from an area of skin, comprising:

a base member, a first handle member having first finger-engagement means at a first end and a first locating post on a second end, said first handle member being pivotally attached to said base member, a second locating post located proximate said first finger-engagement means, a second handle member having second finger-engagement means at a first end and a third locating post on a second end, said second handle member being pivotally attached to said base member, a fourth locating post located proximate said second finger-engagement means, an elongate member disposed around said first, second, third, and fourth locating posts, said elongate member being in twisted engagement at a location between said first and third locating posts and said second and fourth locating posts, said hair removal device having a first position and a second position, and biasing means for biasing said hair removal device toward said first position, said biasing means being an elastic member which connects said second end of said first handle member and said second end of said second handle member, wherein in said first position said second end of said first handle member is located proximate said second end of said second handle member, and the twisted section of said elongate member is at first location, and wherein in said second position said first finger-engagement means and said second finger-engagement are closer together than in said first position, said second ends of said first and second handle members are farther apart than in said first position, and the twisted section of said elongate member is at a second location, said second location being farther from said second ends of said first and second handle members than said first location.

18. The hair removal device of claim 5 wherein said elongate member comprises a loop of material.

19. The hair removal device of claim 5 further comprising a second elongate member, said elongate members being in mutually twisted engagement to form said twisted portion.

20. The hair removal device of claim 5 wherein said elastic tensioner is wrapped around a locating post extending from said base member.

21. The hair removal device of claim 1 wherein said elongate member is wrapped around said plurality of locating posts.

* * * * *